US006123289A

United States Patent [19]

Manole et al.

[11] Patent Number: 6,123,289

[45] Date of Patent: Sep. 26, 2000

[54] TRAINING PROJECTILE

[75] Inventors: Leon Manole, Great Meadows; William Rice, Succasunna; Stewart Gilman; John Dineen, both of Wharton, all of N.J.; Frank Renner, Stroudsburg, Pa.; Mark Young, Wharton; Anthony Farina, Hackettstown, both of N.J.

[73] Assignee: The United States of America as represented by the Secretary of the Army, Washington, D.C.

[21] Appl. No.: 09/071,453

[22] Filed: Apr. 20, 1998

Related U.S. Application Data

[60] Provisional application No. 60/050,452, Jun. 23, 1997, and provisional application No. 60/073,348, Feb. 2, 1998.

[51] Int. Cl.[7] ..... F42B 10/00; F42B 10/56; F42B 8/00; F42B 8/12

[52] U.S. Cl. ..... 244/3.24; 244/3.3; 102/386; 102/529; 102/395; 102/439; 102/501

[58] Field of Search ..... 244/3.1, 3.24, 244/3.3, 130, 113, 3.23; 102/386, 387, 388, 529, 395, 430, 439, 517, 501

[56] References Cited

U.S. PATENT DOCUMENTS

| | | | |
|---|---|---|---|
| H854 | 12/1990 | Madderra | 244/3.3 |
| 463,922 | 11/1891 | Russell | 102/501 |
| 2,494,026 | 1/1950 | Anderson | 244/3.24 |
| 2,979,285 | 4/1961 | Planitzer | 244/3.24 |
| 3,047,259 | 7/1962 | Tatnall et al. | 102/386 |
| 3,067,971 | 12/1962 | Dew | 244/113 |
| 3,532,300 | 10/1970 | Bucklisch et al. | 244/3.3 |
| 4,112,843 | 9/1978 | Laviolette | 244/3.3 |
| 4,832,288 | 5/1989 | Kendall et al. | 244/3.24 |
| 5,070,791 | 12/1991 | Dineen et al. . | |
| 5,125,344 | 6/1992 | Kline et al. | 244/3.3 |
| 5,164,538 | 11/1992 | McClain, III | 102/501 |
| 5,223,667 | 6/1993 | Anderson | 244/3.3 |
| 5,282,588 | 2/1994 | August | 244/3.3 |
| 5,328,130 | 7/1994 | Gilman et al. . | |
| 5,498,160 | 3/1996 | Farina et al. . | |
| 5,610,365 | 3/1997 | Thiesen | 102/430 |
| 5,622,335 | 4/1997 | Trouillot et al. | 244/3.24 |
| 5,639,985 | 6/1997 | Gerner et al. | 244/3.1 |
| 5,650,589 | 7/1997 | Thiesen | 102/430 |
| 5,725,179 | 3/1998 | Gilman et al. . | |
| 5,871,173 | 2/1999 | Frank et al. | 244/113 |
| 5,929,370 | 7/1999 | Brown et al. | 102/501 |

*Primary Examiner*—Theresa M. Wesson
*Attorney, Agent, or Firm*—John Moran; Michael Sachs

[57] ABSTRACT

An aerodynamic device, such as a projectile includes an elongated forebody, and an aft section secured to the forebody. The aft section acts as a drag control device, and includes a connecting member that extends integrally in a conically shaped flared section, for generating a lift force to help stabilize the projectile during forward flight. The aft section further includes a flange that extends from the flared section, and that provides velocity decay and optimal drag, in order to limit the projectile flight and descent within a predetermined safety or emergency range. The flared section is defined between an innermost edge positioned adjacent to the connecting member, and an outermost edge positioned adjacent to the flange. The flange includes a forward facing wall that extends from the outermost edge and that has a height "H" that controls the amount of drag on the projectile, such that the outer diameter of the aft section is less than, or equal to the inner diameter of the gun barrel from which the projectile is fired.

15 Claims, 4 Drawing Sheets

TRAINING PROJECTILE

This application claims benefit of the filing date of provisional application serial No. 60/050,452 filed Jun. 23, 1997 and 60/073,348 filed Feb. 2, 1998, the entire file wrapper contents of which applications are herewith incorporated by reference as though fully set forth herein at length.

GOVERNMENTAL INTEREST

The invention described herein may be manufactured and used by or for the Government of the United States for governmental purposes without the payment of any royalties thereon.

FIELD OF THE INVENTION

This invention relates to projectiles, and it particularly relates to a training projectile with improved drag control. More specifically, the training projectile includes an aft section that causes velocity decay and provides high drag, in order to limit the projectile flight and descent to a predetermined safety or emergency range, while maintaining the flight characteristics of a corresponding service projectile.

BACKGROUND OF THE INVENTION

In the science of ballistics, shock waves emanating from a projectile in flight and traveling faster than the speed of sound, interfere with and break-up the flow of air close to the aft or back end of the projectile. The disruption of air flow affects the flight of the projectile. In order to compensate for, or overcome such perceived interference and to impart spin to a projectile fired from a non-rifled or smooth bore system, the projectile is manufactured to include a boom or extension which provides distance between the nose and fins. In effect, the boom ensures that the fins, which might extend beyond the diameter of the body of the projectile, will contact intact air flow.

Alternatively, the projectile may have expanding fins. In such a case, the fins are hinged and spring loaded to the body of the projectile so that as the projectile exits the bore of a cannon on firing, and the fins expand beyond the caliber or diameter of the body of the projectile to engage intact air flow causing the projectile to spin.

U.S. Pat. No. 5,498,160 to Farina et al., which is incorporated herein by reference, describes a training projectile adapted to fly with limited range. The projectile includes a main cylindrical body having a generally conical nose cone at the front end of the main body, and a tail portion extending from the rear end of the main body. The tail portion includes a flared member which flares outwardly from the rear end of the main body to a tail portion end and provides drag in flight to limit the length of the flight. The tail portion also includes means to impart spin to the projectile, which means includes a plurality of slots in the flared member that are disposed at an angle relative to the longitudinal axis to impart spin to the projectile.

U.S. Pat. No. 5,328,130 to Gilman et al., which is incorporated herein by reference, describes an aft section connected to the nose of a projectile for imparting spin to the projectile. The aft section has two or more coaxial, adjacent, and integrally connected cylindrical segments of different diameters. The segment having the larger diameter is positioned most rearwardly of the projectile, relative to the nose of the projectile, and the periphery of this segment has circumferentially spaced angled slots for catching air moving past the projectile to spin the projectile. The segment with the smaller diameter attaches the cylindrical stabilizer to the aft end of the nose of the projectile and directs the flow of air to and through the angled slots of the segment having the larger diameter.

U.S. Pat. No. 5,070,791 to Dineen et al., which is incorporated herein by reference, describes a range limiting type of projectile used with a selective cartridge in a smooth bore gun. The projectile has a body member and a connecting tail cone which provides projectile roll, velocity decay and high drag to limit the projectile range. The tail cone has a conical outer surface that has a plurality of canted grooves.

The structures described above may have satisfied their intended purpose. However, there is still an unsatisfied need for an improved training projectile that simulates the velocity and flight characteristics of a service projectile with high drag control to limit the projectile flight range. More specifically, as the velocity of service projectiles increases, so must the velocity of the training projectiles, so as to simulate real flight characteristics. Training projectiles face strict flight limitations, as they are required to complete their descent within a specific range, for instance 8000 meters. As a result, an increase in velocity must be countered by a corresponding increase in drag.

Increased drag may be obtained, for instance, by increasing the size of the flared member in the Farina et al. patent, but not to exceed the inner diameter of the gun barrel within which the tail portion fits. Therefore, the amount of drag that can be imparted to the training projectile is limited by the physical dimensions of the gun, which, in certain systems, may not be sufficient to meet the flight range limitations imposed upon training projectiles.

SUMMARY OF THE INVENTION

An object of the present invention is to provide a new aerodynamic device, such as projectile with improved drag control. The projectile may be used as a training or service projectile. When used for training purposes, the projectile is capable of meeting the strict flight range requirements even at higher velocities, without necessitating any modification to the gun barrel or to the forward section of the projectile.

Another object of the present invention is to minimize the intrusion volume of the projectile within the propellant bed so as to increase the propellant bed space for a specific gun barrel. This allows added propellant to be used, and consequently greater velocities and penetration to be achieved. Alternatively, a minimal intrusion volume implies a reduction in the amount of propellant used to propel the projectile, thus minimizing the overall cost of a training projectile. As used herein, an intrusion volume is defined as the space of the aft of the projectile embedded within the propellant bed of the cartridge barrel.

The foregoing and additional features and advantages of the present invention are realized by a projectile that includes an elongated forebody and an aft section secured to the forebody. The aft section includes a connecting member that extends integrally in a conically shaped flared section, for generating a lift force to help stabilize the projectile during forward flight. The aft section further includes a flange that extends from the flared section, and that provides velocity decay and optimal drag, in order to limit the projectile flight and descent within a predetermined safety or emergency range. The flared section is defined between an innermost edge positioned adjacent to the connecting member, and an outermost edge positioned adjacent to the flange. The flange includes a forward facing wall that extends from the outermost edge and that has a height "H" that controls the amount of drag on the projectile, such that the outer diameter of the aft section is less than, or equal to the inner diameter of the gun barrel from which the projectile is fired.

BRIEF DESCRIPTION OF THE DRAWINGS

The above and other features of the present invention and the manner of attaining them, will become apparent, and the invention itself will be best understood, by reference to the following description and the accompanying drawings, wherein.

Similar numerals refer to similar elements in the drawings. It should be understood that the sizes of the different components in the figures are not necessarily in exact proportion or to scale, and are shown for visual clarity and for the purpose of explanation.

DETAILED DESCRIPTION OF THE PREFERRED EMBODIMENTS

Figure 1:
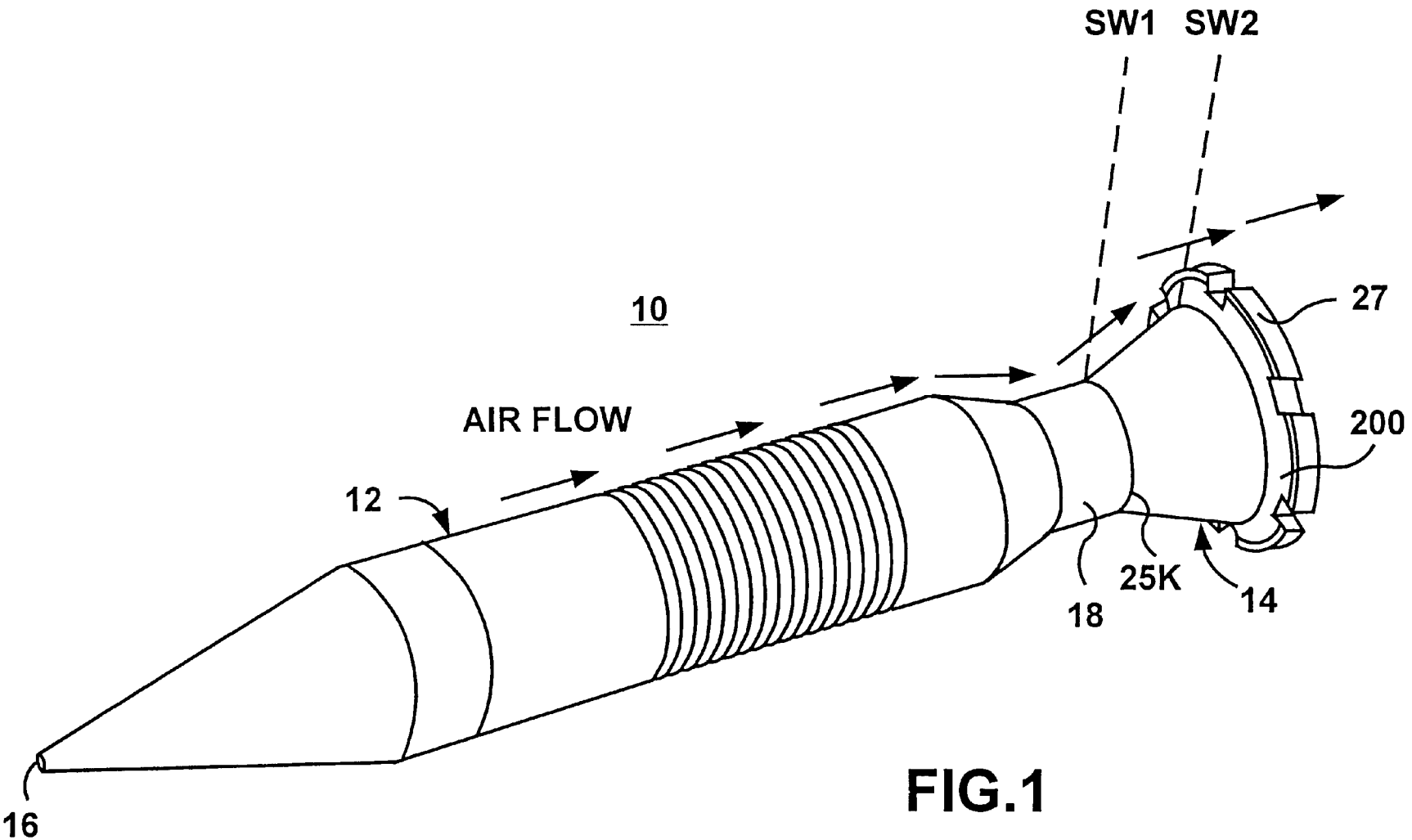
FIG. 1 is a perspective view of a projectile embodying an aft section design according to the present invention.

FIG. 1 illustrates a projectile 10 according to the present invention. The projectile 10 is generally formed of a forebody 12 and an aft section 14. The aft section 14 is secured to a rearwardmost section or tail end 18 of the forebody 12. The projectile 10 may be for example, a tank round for a 120 mm smooth bore system. When the aft section 14 is secured to a training projectile, it ensures that the projectile spins when fired from such smooth bore or non-rifled system, and further provides a velocity decay and high drag, in order to limit the projectile flight and descent within a predetermined safety or emergency range, while maintaining the flight characteristics of a corresponding service projectile.

The forebody 12 of the projectile 10 includes a spike, give or rounded nose 16. The forebody 12 and the aft section 14 of the projectile 10 are typically co-axial. In a preferred embodiment, the rearward shape 18 is generally cylindrically shaped, but other shapes are possible. For example, the rearward shape 18 can be slightly curved for defining a channel.

the diameters of the rearward portion 18 and the forebody 12 can be smaller than the inside diameter of a gun or cannon tube from which the projectile is fired, and may be much less if a sabot were used to hold the projectile 10 centered in the tube. An obturator and a sabot may be fastened about the rearward portion 18 and the forebody 12 to provide a friction fit between the tube and the projectile 10, and to prevent forward thrust gasses from escaping from the tube prior to the escape of the projectile 10 when fired.

Figure 2:
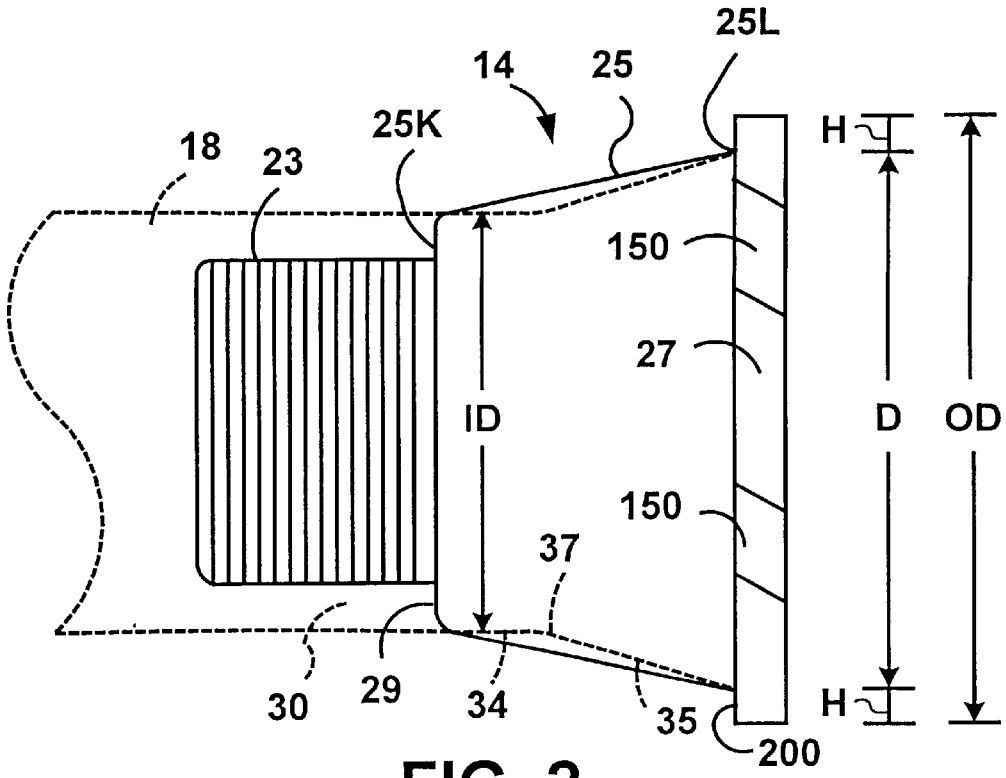
FIG. 2 is an enlarged side elevational view of the aft section forming part of the projectile of FIG. 1.

FIG. 2 is an enlarged side view of the aft section 14. The aft section 14 has a connecting member 23, which is threaded or machined, and which extends integrally in a flared section 25 and a flange 27. The connecting member 23 couples the aft section 14 to the forebody 12. The connecting member 23 may alternatively be a bayonet mount (not shown) or any other suitable device that ensures the integrity of the projectile 10.

The flared section 25 is defined between an innermost edge 25K positioned adjacent to the connecting member 23, and an outermost edge 25L positioned adjacent to the flange 27. In the exemplary embodiment shown in FIG. 2, the flared section 25 is smooth and generally conically shaped. The size of the flared section 25 progressively increases along its axial length, between the diameter ID of the innermost edge 25K, and the diameter D of the outermost edge 25L. For example, the diameter ID ranges between approximately 30 mm and approximately 60 mm; and the diameter D ranges between approximately 70 mm and approximately 105 mm. In a specific embodiment where the projectile 10 is used in a 120 mm smooth bore system, the diameter D of the outermost edge 25L ranges between approximately 80 mm and approximately 105 mm. It should be clear that the values and dimensions stated herein are only for the purpose of illustration, and that the present invention is not limited to these values, but rather other dimensions can alternatively be used.

The innermost edge 25K defines an annularly shaped step 29 with the connecting member 23 for engaging a cylindrically shaped segment 30 (shown in dotted lines) of the rearward portion 18 of the forebody 12. In a preferred embodiment the outer diameter of the segment 30 is substantially equal to the diameter ID of the innermost edge 25K, such that when the projectile 10 is assembled, the forebody 12 and the aft section 14 form a smooth unitary surface. As further illustrated in FIG. 3, the flared section 25 is hollow along its axial length.

The function of the flared section 25 is to generate a lift force to help stabilize the projectile 10 during forward flight. While a flared section has been described as being conically shaped, it should be understood to a person of ordinary skill in the art that the flared section 25 can assume various shapes without departing from the scope of the present invention. For example, the flared section 25 can have distinct sides, for example flat sides (i.e., polygonal) and/or arcuately shaped sides.

According to another embodiment of the present invention, which is illustrated by dashed lines, the flared section 25 is not conically shaped, but rather includes a forward section 34 that extends in a flared section 35. The forward section 34 is smooth and generally cylindrically shaped, and extends integrally from the connecting member 23. The forward section 34 is preferably shaped in such a way as to impart an aerodynamically continuous and smooth surface in cooperation with the rearward portion 18 when the projectile 12 is assembled.

The flared section 35 extends integrally from the forward section 34, and has similar function and design to the flared section 25. The forward section 34 and the flared section 35 define an edge 37 which preferably has a smooth curvature. Alternatively, the edge 37 can form a sharp edge.

Figure 2A:
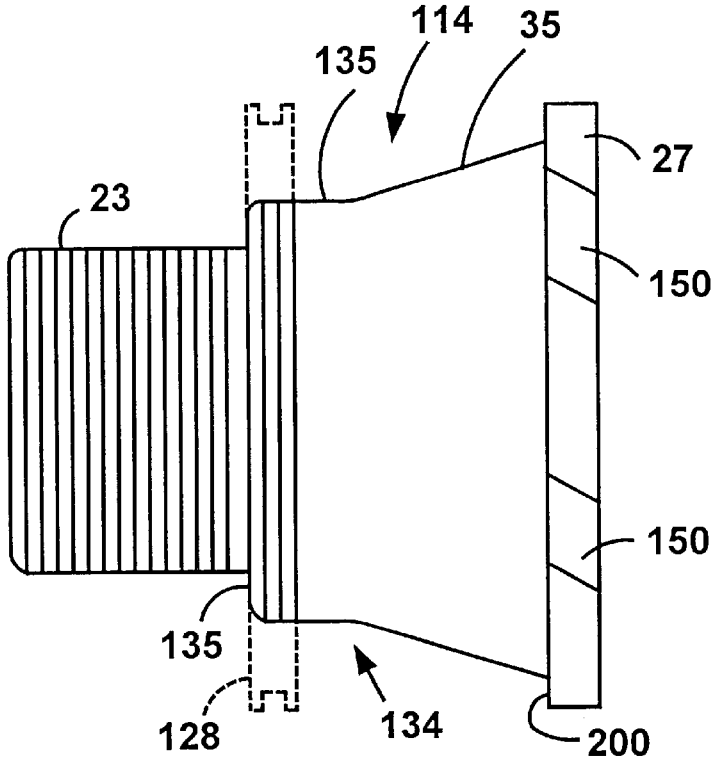
FIG. 2A is an enlarged side elevational view of an alternative aft section forming part of the projectile of FIG. 1.

FIG. 2A illustrates an aft section 114 which is generally similar in function and design to the aft section 14 of FIG. 2, but which includes a forward section (or clamp section) 134 for attachment to a clamping means such as a ring clamp 128 (shown in dashed lines). The aft section 114 has a connecting member 23 that extends integrally into the forward section 134, a flared section 35 and a flange 27. The connecting member 23 connects the aft section 114 to the forebody 12. The forward section 134 further includes a smooth, cylindrical segment 135 that extends integrally from the threaded segment 134.

With reference to FIGS. 1 and 2, the flange 27 is ring-shaped, and has equally spaced, circumferentially positioned, angled grooves 150 or air flow-through channels, which traverse the entire axial length of the flange 27. The flange 27 includes a ring-shaped, upright, forward facing wall 200 that extends from the outermost edge 25L of the flared section 27, that is generally normal to the axis of the projectile 10. The maximum outer diameter "OD" of the flange 27 is less than, or equal to the inner diameter of the gun barrel. The thickness of the flange 27 varies with the desired application and use of the projectile 10.

Though the preferred overall shape of the flange 27 is circular, it should be understood that other shapes are possible. For instance, the overall shape of the flange 27 can be polygonal or arc shaped, provided the flange 27 fits within the gun tube or barrel.

The function of the aft section 14, and in particular the function of the flange 27, is to increase drag on the projectile 10 during all phases of flight. In operation, the impingement of air on the forward facing wall 200 increases the drag acting on the aft section 14. The height "H" of the forward facing wall 200 controls the amount of drag on the aft section 14. As the height "H" increases, so does the drag.

The drag generated by the forward facing wall 200 of the flange 14 is balanced (or traded off) against the lift forced generated by the flared section 25, so that the projectile 10 achieves an optimal flight path within a predetermined safety or emergency range. For example, the safety range usually does not exceed 8000 meters, and the training projectile 10 simulates the flight path of a tactical projectile along a path ranging between approximately 2000 meters and 4000 meters.

The height "H" of the forward facing wall 200 and the diameter "D" of the edge of the outermost edge 25L are related to the outer diameter "OD" of the flange 27, by the following equation:

$$OD=D+2H.$$

The outer diameter "OD" is typically fixed, and is limited by the inner diameter of the tube barrel. As "D" decreases, "H" increases, causing the lift generated by flared section 25 to decrease, and the drag generated by the flange 27 to increase. Thus, the aft section 14 provides the ability to precisely control the flight characteristics of the projectile 10.

Figure 3:
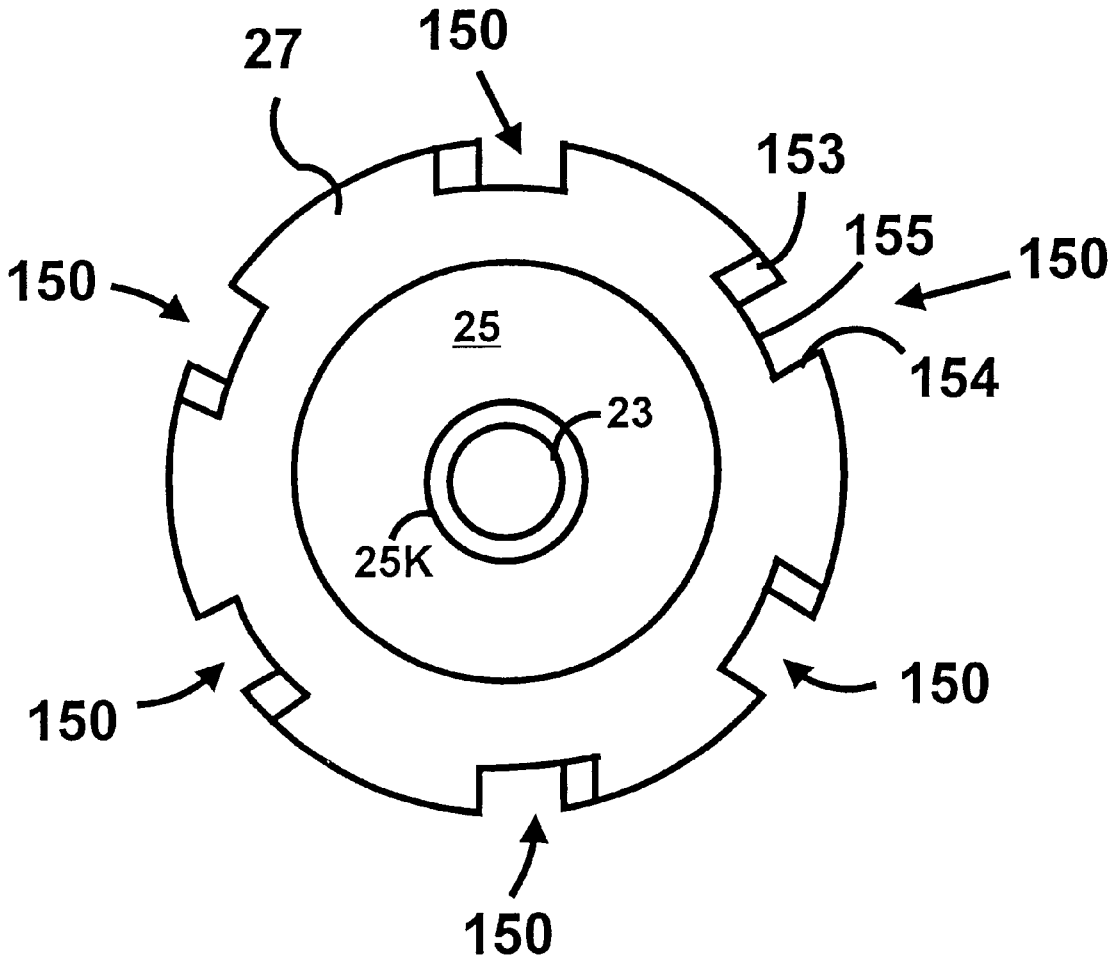
FIG. 3 is a rear view of the aft section of FIG. 2.

With reference to FIG. 3, the grooves 150 are defined by substantially parallel side walls 153, 154, separated by a surface 155 which may be either planar or arcuately shaped. The number of grooves 150, and the groove width, or more accurately the perpendicular distance between the side walls 153, 154, may vary with the design objectives. In one embodiment the groove width ranges between approximately 1 mm and 25 mm (though other values can be selected). The side walls 153, 154 are sloped for creating the angled grooves 150. Compared to conventional projectile designs, a thinner flared section 25 (or 35) is now possible since the slots are formed in the flange 27 rather than in the flared section 25 (or 35).

The grooves 150 are equally spaced apart about the periphery of the flange 27. While only six grooves 150 are shown for the purpose of illustration, it should be clear that a different number may alternatively be selected. For instance, the number of grooves 150 may range between 3 and 8 or more. The sloping angle of the groove walls 153, 154 can have any suitable value between 0 degree and 90 degrees provided it renders an acceptable projectile dispersion while avoiding projectile spin yaw resonance. Preferably, the sloping angle varies between approximately 5 degrees and 45 degrees, and most preferably, for the 120 mm caliber cannon the angle is approximately 20 degrees. The depth of the angled grooves varies, but in an exemplary embodiment, the depth varies between approximately 5 mm and approximately 25 mm.

Though the inclusion of the grooves 150 is preferable to provide spin torque and stability to the projectile 10, other embodiments do not include the grooves 150. Furthermore, the grooves 150 lower the drag acting on the projectile 10, and thus the number of grooves 150 should be taken into consideration when evaluating the desired drag on the projectile 10.

The aft section 14 may be machined from a solid piece of aluminum, steel, titanium, or other suitable materials such as light and malleable metals, or formed or molded from plastic, plastic composites, ceramics, etc. In certain applications, such as when the projectile 10 is used in a small caliber gun, the aft section 14 can be molded of plastic material.

In operation, as the projectile 10 exits the bore of the tube barrel at a supersonic speed, i.e., above the speed of sound, air flows over the axial length of the forebody 12, is directed over the rearward portion 18, and generates a first shock wave SW1 at the innermost edge 25K of the flared section 25. The airflow progresses over the flared section 25 and generates a second shock wave SW2 as it reaches the wall 200. Air passes through the grooves 150 and exerts a force on the groove walls 153, 154, causing the projectile 10 to spin in a predetermined direction, such as the clockwise direction. By reversing the slope of the groove walls 153, 154 the projectile 10 will rotate in the opposite direction.

These shock waves SW1, SW2, and particularly the second shock wave SW2, induce the desired additional drag on the projectile 10. It is estimated that the second shock wave SW2 increases drag on the projectile 10 to 20 percent over the first shock wave SW1.

Figure 4:
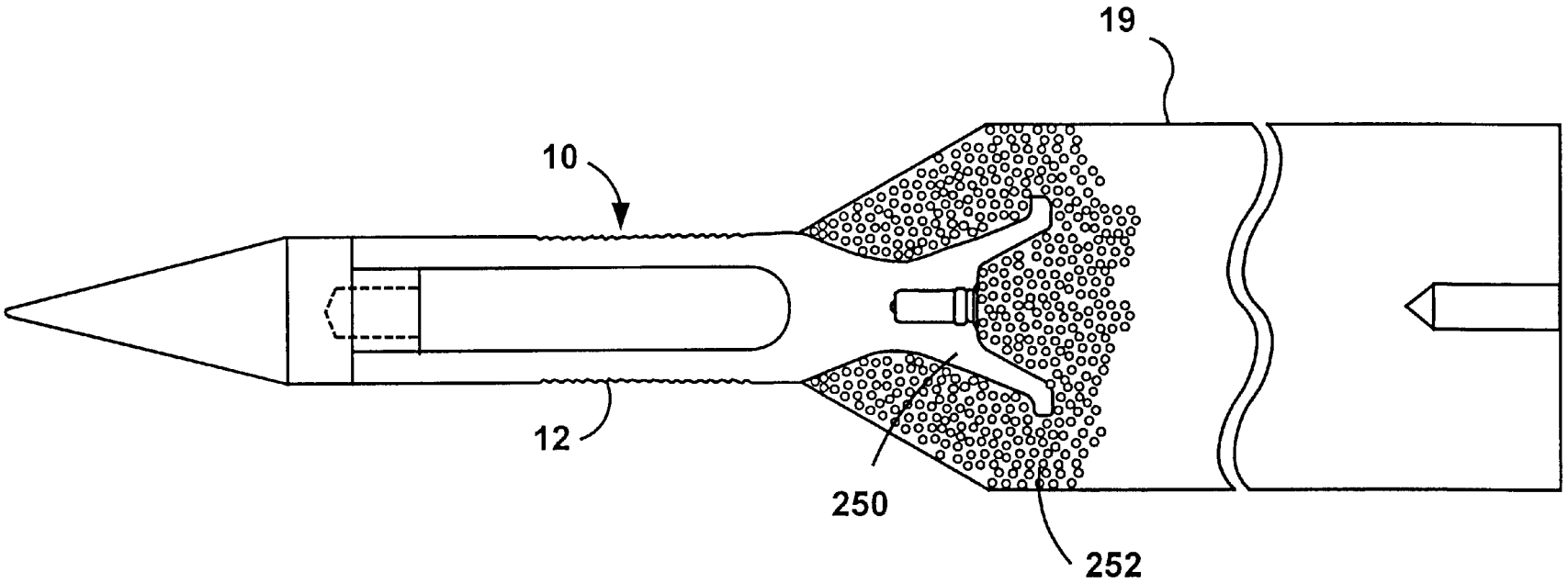
FIG. 4 is a fragmentary, cross sectional view of a projectile embodying another aft section design according to the present invention, shown secured to a cartridge.

FIG. 4 illustrates a projectile 10 embodying another aft section 250 according to the present invention, shown secured partly within the cartridge. The aft section 250 is substantially similar in design, outer dimensions, and function to the aft section 14, with the exception that the aft section 250 is integrally formed as part of the forebody 12.

FIG. 4 further illustrates the intrusion volume occupied by the aft section 250 within the cartridge case 19. As defined above, the intrusion volume refers to the volume occupied by the aft section 250 when embedded within the propellant bed 252. For a desired drag to be generated on the projectile 10, less intrusion volume by the aft section 250 (or 14) would be required, than would be required with a conventional aft section design. As a result, the present aft section 250 maximizes the storage volume within the cartridge case 19, and consequently a less expensive or less energetic propellant can be used to accomplish the same or greater energy transfer at the same velocity, than with a conventional aft section. With the present aft section (250, 14) design it is expected to achieve a cost saving of approximately one half the cost of the propellant.

In addition, while the total length of the conventional aft section, including the connecting member 23, is approximately 158.7 mm, which is about ¼ the length of the projectile, the overall length of the aft section 14 according to the present invention, ranges between approximately 120 mm and approximately 140 mm, thus achieving a reduction of approximately 20 percent in the overall length of the aft section (250 or 14), not accounting for the connecting member 23. According to one design, the length of the connecting member 23 is approximately 25.4 mm. Furthermore, a reduction in the length of the aft section (250, 14) implies a reduction in the material used in the production of the aft section, and consequently an additional cost saving.

According to another embodiment, the forebody 12 includes circumferential grooves or threads, as described in U.S. Pat. No. 5,498,160. A tracer cavity and a tracer plug (not shown) are inserted inside the rear end of the aft section 14, as is generally practiced in the field.

It should be apparent that many modifications may be made to the invention without departing from the spirit and scope of the invention. Therefore, the drawings, and description relating to the use of the invention are presented only for the purposes of illustration and direction.

What is claimed is:

1. A projectile to be fired from a barrel having an inner diameter, comprising:

an elongated forebody;

an aft section secured to a rearward section of said forebody;

said aft section including a connecting member that extends integrally in a flared section; and a flange;

said connecting member securing said aft section to said forebody;

said flared section extending from said connecting member to said flange;

said flared section defining a generally solid conical surface that generates a lift force to help stabilize the projectile during forward flight;

said flange providing a velocity decay and drag, in order to limit the projectile flight and descent within a predetermined safety or emergency range;

wherein said flange is connected at the rearward edge of said flared section, and includes a forward facing wall that extends from said outermost edge of said flared section;

wherein said forward facing wall has a height (H) that controls the amount of drag on the projectile; and wherein as the projectile exits the barrel, air is directed over the rearward section, generates a first shock wave (SW1) at an innermost edge of the flared section, and progresses over the flared section, and generates a second shock wave (SW2) as it reaches the forward facing wall, so as to counteract the lift force by increasing drag on the projectile.

2. A projectile according to claim 1, wherein said flared section is defined between an innermost edge positioned adjacent to said connecting member, and an outermost edge positioned adjacent to said flange.

3. A projectile according to claim 1, wherein said flared section is smooth.

4. A projectile according to claim 3, wherein the size of said flared section progressively increases along its axial length, between said innermost edge and said outermost edge.

5. A projectile according to claim 4, wherein said innermost edge has a diameter (ID) that ranges between approximately 30 mm and approximately 60 mm.

6. A projectile according to claim 4, wherein said outermost edge has a diameter (D) that ranges between approximately 70 mm and approximately 105 mm.

7. A projectile according to claim 4, wherein said innermost edge defines an annularly shaped step with said connecting member, for engaging said rearward section of said forebody.

8. A projectile according to claim 1, wherein said aft section further includes a forward section that extends between said connecting member and said flared section.

9. A projectile according to claim 8, wherein said forward section and said flared section define an edge with a smooth curvature.

10. A projectile according to claim 8, wherein said forward section includes a clamp section for attachment to a cartridge case.

11. A projectile according to claim 1, wherein said flange is substantially ring-shaped, and has substantially equally spaced, circumferentially positioned, angled grooves.

12. A projectile according to claim 1, wherein said flange has a diameter that is less than, or equal to the inner diameter of the barrel.

13. A drag control device for attachment to an aerodynamic device, comprising:

a connecting member for connection to the aerodynamic device;

a flange;

a flared section extending from said connecting member to said flange;

said flared section defining a generally solid conical surface that generates a lift force to help stabilize the aerodynamic device during flight;

said flange extending outwardly from said flared section for providing a velocity decay and drag to the aerodynamic device;

wherein said flange is connected at the rearward edge of said flared section, and includes a forward facing wall that extends from an outermost edge of said flared section;

wherein said forward facing wall has a height (H) that controls the amount of drag on the aerodynamic device; and wherein as the aerodynamic device is in flight, air is directed over a rearward section, generates a first shock wave (SW1) at an innermost edge of the flared section, and progresses over the flared section, and generates a second shock wave (SW2) as it reaches the forward facing wall, so as to counteract the lift force by increasing drag on the aerodynamic device.

14. A drag control device according to claim 13, wherein said flange includes circumferentially positioned grooves.

15. A drag control device according to claim 13, wherein the aerodynamic device is a projectile body; and wherein said connecting member is secured to said projectile body.

* * * * *